United States Patent [19]

Lemkin

[11] Patent Number: 4,523,692

[45] Date of Patent: Jun. 18, 1985

[54] REVERSIBLE SECURITY COVER FOR STACKABLE AND NESTABLE TOTE BOX

[76] Inventor: Jack Lemkin, 3945 Brookham Dr., Grove City, Ohio 43123

[21] Appl. No.: 509,581

[22] Filed: Jun. 30, 1983

[51] Int. Cl.[3] ..... B65D 41/16; B65D 43/10; B65D 21/04

[52] U.S. Cl. ..... 220/306; 206/508; 220/70; 220/210; 220/315; 220/307

[58] Field of Search ..... 206/508; 220/21, 70, 220/306, 307, 315

[56] References Cited

U.S. PATENT DOCUMENTS

| | | | |
|---|---|---|---|
| 2,582,245 | 1/1952 | Folli | 220/70 |
| 3,186,586 | 6/1965 | Box | 220/21 |
| 3,331,529 | 7/1967 | Slapnik | 206/508 |
| 3,341,053 | 9/1967 | Keene | 220/21 |
| 3,360,162 | 12/1967 | Miles | 206/508 |
| 3,376,046 | 4/1968 | Kivett | 206/508 |
| 3,379,341 | 4/1968 | Miles | 206/508 |
| 3,606,074 | 9/1971 | Hayes | 220/287 |
| 3,979,016 | 9/1976 | Frater | 206/508 |
| 4,018,338 | 4/1977 | Lemkin | 206/508 |
| 4,061,241 | 12/1977 | Retelny | 206/508 |

FOREIGN PATENT DOCUMENTS

| | | | |
|---|---|---|---|
| 910495 | 3/1982 | U.S.S.R. | 206/508 |

*Primary Examiner*—George E. Lowrance

*Attorney, Agent, or Firm*—Martin P. Hoffman; Mitchell B. Wasson; Charles W. Fallow

[57] ABSTRACT

A tote box with a separate security cover, both components being executed in plastic. The tote box is an upwardly opening rectangular receptacle. The security cover is symmetrical and has locking tabs on opposite ends thereof so that the cover can be snapped into locking engagement with slots defined in the receptacle. The security cover can also be flipped over, or reversed, and positioned atop the receptacle to increase its capacity. Tote boxes can be stacked upon one another with the security cover either locked or seated thereon, and the tote boxes can be nested one within another when the covers are removed.

4 Claims, 17 Drawing Figures

REVERSIBLE SECURITY COVER FOR STACKABLE AND NESTABLE TOTE BOX

BACKGROUND

1. Field of the Invention

This invention relates generally to stackable and nestable tote boxes and separate security covers therefor, and more particularly to reversible, symmetrical security covers with integral locking tabs that can be secured to the tote box in one position and can be seated upon the tote box in a second position.

2. Prior Art

Tote boxes and separate covers therefor, executed in plastic, are well known. Such boxes have found wide spread acceptance for the transport of packaged goods from a manufacturing installation or warehouse to a retail store, such as a supermarket, drug store, beauty shop, or the like. Such boxes and covers are designed so that the boxes, with the lids secured thereon, can be stacked one upon the other, with the lids removed, the boxes can be nested one within the other. The covers are also stackable, independently of the tote boxes, so that storage space can be minimized.

The covers for the tote boxes frequently have tongues defined at one end, and hook-like flanges are defined at the other end. The flanges are pressed downwardly until they are positioned behind the lip of the tote box, and then the tongues are snapped into slots in the end walls of the boxes. The covers are asymmetrical in shape. Representative tote boxes are disclosed in U.S. Pat. No. 3,360,162, granted to Robert F. Miles, in U.S. Pat. No. 3,379,341, also granted to Robert F. Miles, and in U.S. Pat. No. 3,979,016, granted to James J. Frater.

While known tote boxes and security covers therefor have grown in popularity and have found uses too diverse to catalog, certain structural and functional shortcomings have been noted. To illustrate, in the Miles '162 patent, the resiliency of the cover precluded the desired locking interengagement of the tongue on the cover with the slots in the side walls of the tote box. Since known security covers are asymmetrical, the covers have to be properly aligned prior to stacking. Furthermore, known security covers have been difficult, and relatively expensive, to mold upon expensive side action molds to accommodate the.

SUMMARY

The invention relates to an integrally molded, sturdy plastic tote box and security cover. The tote box can be nested and stacked with known tote boxes, and the security cover is compatible with known tote boxes as well as with the instant tote box.

The instant security cover, in its normal orientation, has locking tabs formed at its opposite ends. The locking tabs project horizontally and are wedge-shaped. The tabs are snapped into slots in the opposing side walls of the tote boxes. The security cover is symmetrical in shape, and can be stacked and nested without regard for the end-to-end orientation necessary with known covers.

A continuous, unbroken horizontally extending flange is formed about the perimeter of the security cover, and a first and second overhang depend downwardly from opposite ends of the flange. The flange, with the overhangs, properly position the security cover on the tote box so tht the locking tabs function repeatedly and effectively over extended periods of time. The security cover may be relieved in the area of the locking tabs to enhance the resiliency of the security cover.

The security cover, in its normal orientation in which it can be joined to the tote box, has a slightly dished central section. However, the security cover is versatile, and can be flipped over so that the dished section projects upwardly. The security cover can be seated upon the tote box in this reversed position and can increase the load carrying capacity or usable volume defined between the cover and the tote box. Although the locking tabs are ineffective in this reversed position, bosses defined on the security cover allow bundling or banding straps to be passed about the cover and the tote box.

The tote box employs grippers in its end walls so that the box may be transported more readily by conveyors. Strapping grooves are defined at the junction of the side walls and the bottom of the box, so that bundling or banding straps can be retained in fixed positions. Triangular stabilizers are formed about the tote box so that several boxes can be stacked or nested without tipping.

The configuration of the tote box and the security cover has been judiciously determined so that simpler molds can be employed, and production costs can be lowered.

Yet other objects and advantages will become evident from the ensuing description when construed in harmony with the appended drawings.

DESCRIPTION OF THE PREFERRED EMBODIMENT

Figure 1:
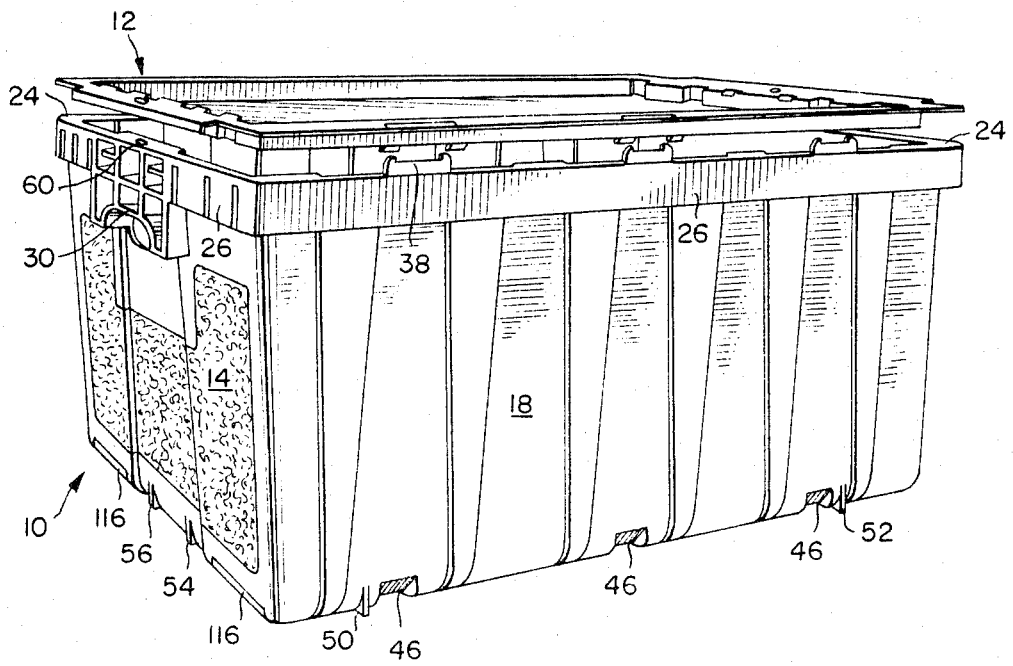
FIG. 1 is an exploded perspective view of a tote box and security cover constructed in accordance with the principles of this invention, the security cover being shown prior to engagement with the tote box.
Figure 2:
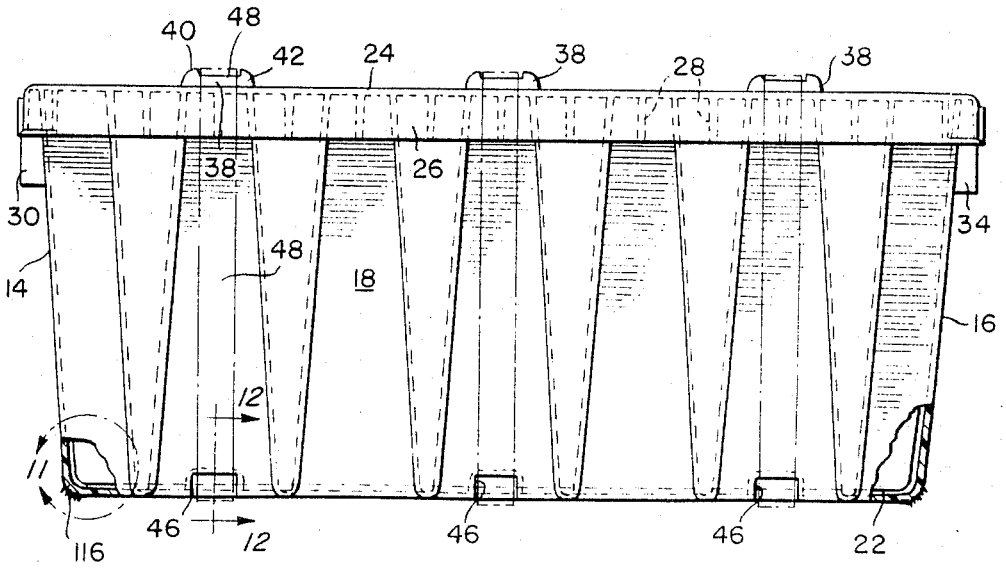
FIG. 2 is a side elevational view of the tote box.
Figure 3:
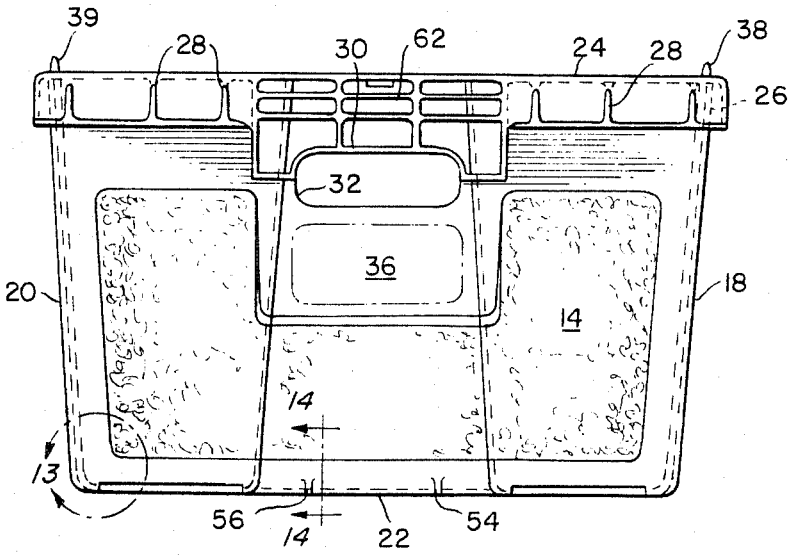
FIG. 3 is an end elevational view of the tote box.
Figure 4:
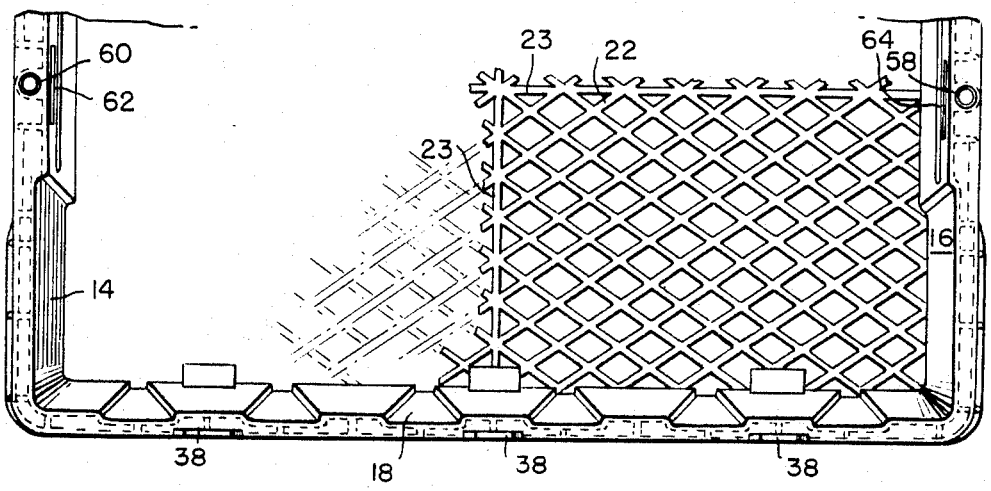
FIG. 4 is a fragmentary top plan view showing the inwardly tapering sides and bottom of the tote box.

Referring now to the drawings wherein identical parts are identified by the same reference numerals, FIG. 1 depicts a tote box, indicated generally by reference character 10, about to receive a security cover, indicated generally by reference numeral 12. FIGS. 2–4 depict the tote box 10 with the cover 12 removed therefrom for the sake of clarity.

FIGS. 2–4 illustrate that tote box 10 assumes an upwardly opening, substantially rectangular shape. Box 10 comprises a first end wall 14, a second end wall 16, a first side wall 18, a second side wall 20, and a bottom 22 that joins the end walls and the side walls together. The bottom is lattice shaped, and has intersecting strengthening ribs 23. The box is executed in plastic by conventional molding techniques, and the walls and the bottom are integrally formed. The walls taper slightly outwardly as they rise upwardly from the bottom 22. Bottom 22 is an open lattice-like member that allows ready drainage for the tote box.

A horizontal lip 24 extends, in a continuous, unbroken fashion around the perimeter of the tote box 10, and a skirt 26 depends vertically therefrom. Several fillets 28 are formed between the skirt 26 and the walls of the tote box, so that the skirt is rigid. The fillets disposed along the side walls are indicated in phantom outline in FIG. 2, and the outer ends of the fillets disposed along the end walls are shown in solid lines in FIG. 3.

An arcuate hand grip 30 is located in end wall 14, and an aperture 32 is formed adjacent thereto. A similar hand grip 34 and an aperture (not shown) are located in end wall 16. The hand grips and apertures enable the tote box 10, even when fully loaded, to be grasped, lifted and transported. End walls 14, 16 may be surface treated in the vicinity of the hand grips to receive markings in chalk, marking pen, etc.; the surface treatment is suggested by the stippling. Also, an informational placard 36 may be secured to the end wall 14.

Strap guides 38 extend upwardly above the lip 24 along side wall 18 and three strap guides 39 extend upwardly above lip 24 on side wall 20. Three guides 38 are spaced along each side wall in the preferred embodiment, and the guides 38 on wall 18 are aligned longitudinally and vertically with the guides 39 on wall 20. Ears 40, 42 are formed at the opposite longitudinal edges of each guide, and a shallow shelf 44 is formed between the ears. Three strapping grooves 46 are formed adjacent the intersection of side wall 18 and bottom 22, and three identical grooves (not shown) are formed in side wall 20. The grooves are aligned with one of the guides 38, 39. Three sealing straps 48, shown in dotted outline in FIG. 2, can be passed about the guides 38 and 39, and through the groove 46 on the exterior of the box 10 to retain security cover 12 in fixed position and prevent access to the contents of the box. Ears 40, 42 retain the straps in the guides 38 and 39.

A pair of triangular stabilizers 50, 52 extend outwardly from the curved intersection of side wall 18 and bottom 22 of box 10. A second, identical pair of stabilizers (not shown) extend outwardly from the intersection of side wall 20 and bottom 22 of box 10. Stabilizers 54, 56 may also be formed at the intersection of the end walls and the bottom 22 of the tote box. The stabilizers enhance the stacking capability of the tote box 10.

A small opening 58 is located in the middle of lip 24 atop end wall 16, and a similar small opening 60 is located in the middle of lip 24 atop end wall 14, as shown in FIG. 4. A slot 62 is formed in end wall 14 below lip 24, and a similar slot 64 is formed in end wall 16 below lip 24.

Figure 5:
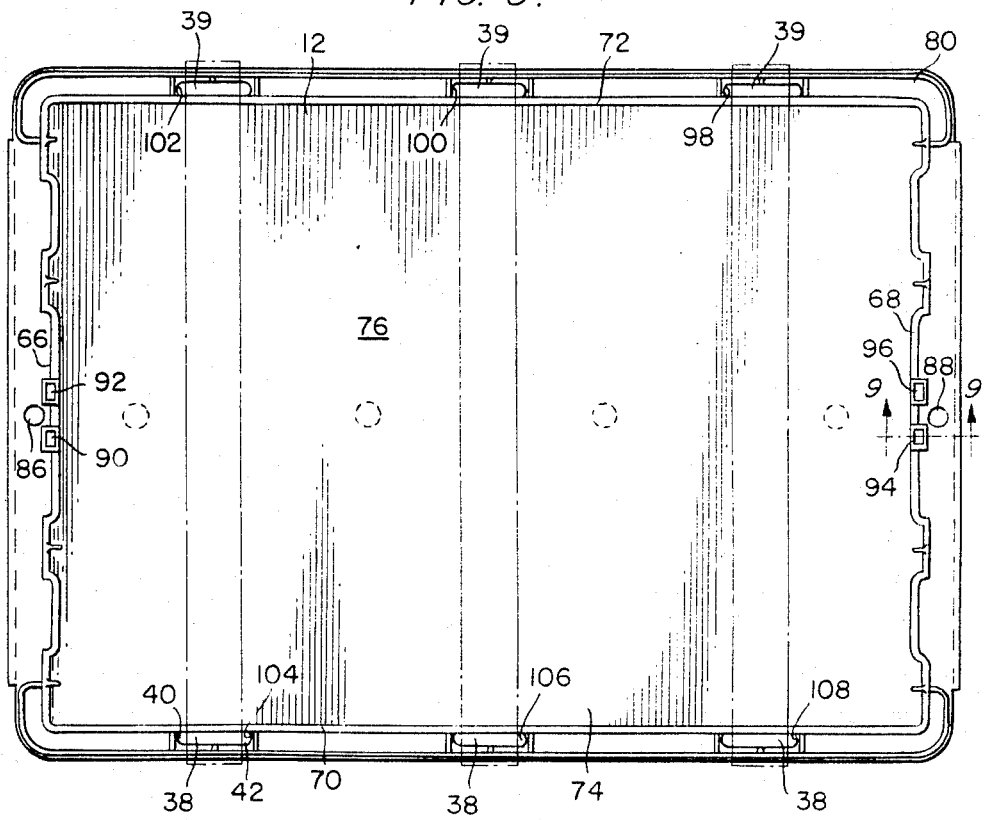
FIG. 5 is a top plan view of the security cover engaged with the tote box.
Figure 6:
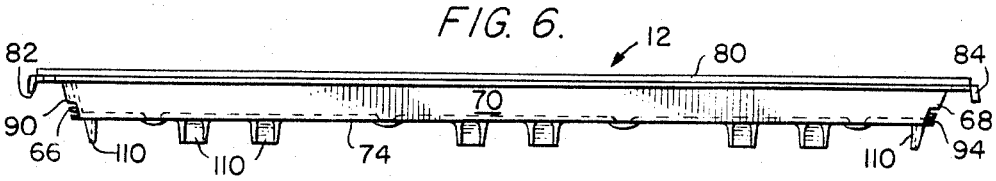
FIG. 6 is a side elevational view of the security cover.
Figure 7:
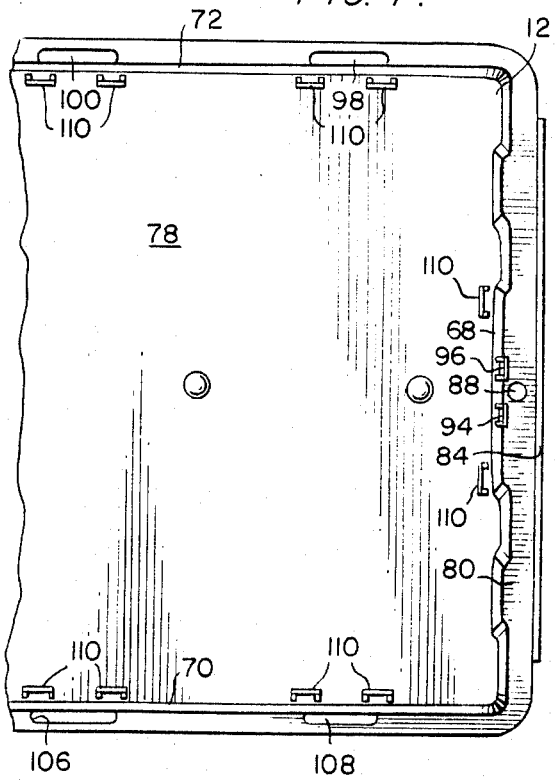
FIG. 7 is a fragmentary plan view of the bottom of the security cover.

FIG. 5 shows the security cover 12 engaged with the tote box 10, while FIGS. 6 and 7 illustrate structural details of the cover 12 apart from the tote box 10. Cover 12 resembles a shallow rectangular dish, and comprises a first end wall 66, a second wall 68, a first side wall 70, a second side wall 72, and a horizontally extending planar bottom 74 that connects the walls together. The upper surface 76 of bottom 74 is shown in FIG. 5, while the lower surface 78 of bottom 74 is shown in FIG. 7. The cover is integrally molded of plastic, and the thickness of the cover is suggested by the dotted outline visible in FIG. 6.

A laterally projecting, continuous flange 80 extends around the periphery of cover 12. A first overhang 82 depends below flange 80 along end wall 66, and a second overhang 84 depends below flange 80 along end wall 68. A first opening 86 is formed in flange 80 at the midpoint of end wall 66, and a second opening 88 is formed in flange 80 at the midpoint of end wall 68. Locking tabs 90, 92 project outwardly from end wall 66 of cover 12 in the vicinity of opening 86, and a similar pair of locking tabs 94, 96 project outwardly from end wall 68 of cover 12 in the vicinity of opening 88. The flange 80 is interrupted by six elongated slots 98, 100, 102, 103, 106 and 108, and the slots allow strap guides 38, 39 to pass therethrough when the cover 12 is seated atop the box 10.

Several bosses 110 depend below the planar bottom 74 of the cover 12, and the bosses are U-shaped when viewed from the bottom, as shown in FIG. 7. The bosses 110 assist in locating the cover 12 upon the box 10, and the bosses spaced along the side walls of the cover are located in proximity to the slots. Also, as shown in FIGS. 5–7, the cover 12 is symmetrical about its lateral and longitudinal axes.

Figure 8:
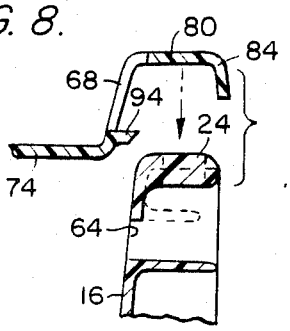
FIG. 8 is an exploded, fragmentary sectional view of the security cover and a side wall of the tote box prior to engagement of the cover with the box.
Figure 9:
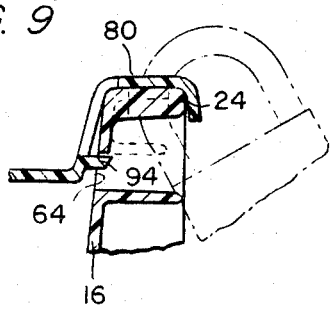
FIG. 9 is a fragmentary view showing the engagement of the cover with the box, such view being taken along line 9—9 in FIG. 5 and in the direction indicated.

FIGS. 8–9 show the manner in which cover 12 is secured to box 10. The cover is pressed downwardly, as suggested by the directional arrow in FIG. 8, until flange 80 and overhang 80 on the cover cotact flange 24 atop side wall 16 of the tote box, as shown in FIG. 9. The cover is sufficiently resilient to allow the locking tabs 94, 96 to snap into slot 64 in the side wall 16. The opposite end of the cover similarly relies upon the coaction between locking tabs 90, 92 on the cover and slot 62 in the side wall 14 to secure the cover to the box. To disengage the cover from the box, the procedure is reversed to withdraw the locking tabs 90, 92, 94, 96 from the slots 62, 64 in the end walls of the box. If the user desires greater security for the contents of the box than that afforded by the locking tabs and slots, a lock (shown in dotted outline), bundling strap, or plastic rivet can be passed through the aligned openings, such as 56, 88, in the box and cover.

Figure 10:
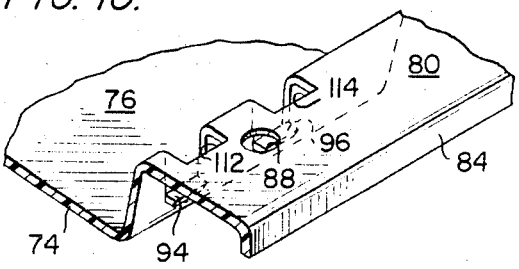
FIG. 10 is a fragmentary perspective view of the locking tabs defined on the security cover.

FIG. 10 shows the details of locking tabs 94, 96 at one end of the security cover 12 on an enlarged scale. Each tab has a horizontally extending upper surface, a somewhat smaller parallel lower surface, and a vertically inclined surface extending between the upper and lower surfaces to define a wedge-like shape. A first L-shaped cut-out 112 is defined in flange 80 and end wall 66 of cover 12 adjacent to tab 94, and a second L-shaped cut-out 114 is defined in flange 80 and end wall 66 of cover 12 adjacent to tab 96. Similar cut-outs are defined at the opposite end of the cover adjacent to locking tabs 90, 92. The cut-outs increase the resiliency of the cover and facilitate the engagement of the cover with the slots 62, 64 in the end walls of the tote box 10.

Figure 11:
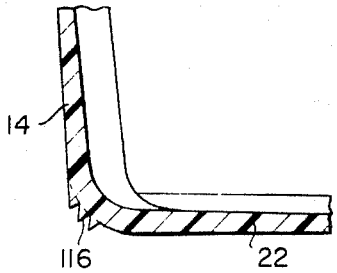
FIG. 11 is a fragmentary view, on an enlarged scale, of a gripper formed on the tote box, such view being taken within the encircled area shown in FIG. 2.
Figure 12:
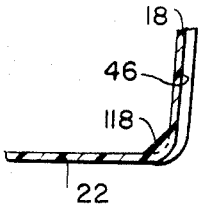
FIG. 12 is a fragmentary view, on an enlarged scale, of a strapping groove defined in the tote box, such view being taken along line 12—12 in FIG. 2.
Figure 13:
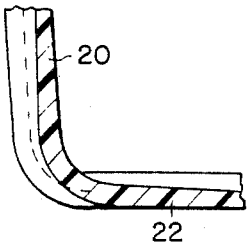
FIG. 13 is a fragmentary view, on an enlarged scale, of a corner of the tote box, such view being taken within the encircled area shown in FIG. 3.
Figure 14:
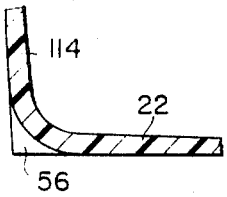
FIG. 14 is a fragmentary view, on an enlarged scale, of a stacking stabilizer for the tote box, such view being taken along line 14—14 in FIG. 3 and in the direction indicated.
Figure 17:
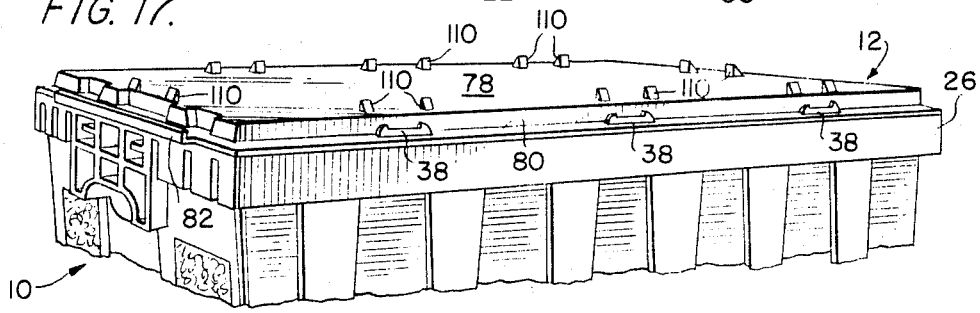
FIG. 17 is a fragmentary, exploded perspective view of the security cover seated upon the tote box, the cover, however, being shown in its reversed position.
Figure 15:
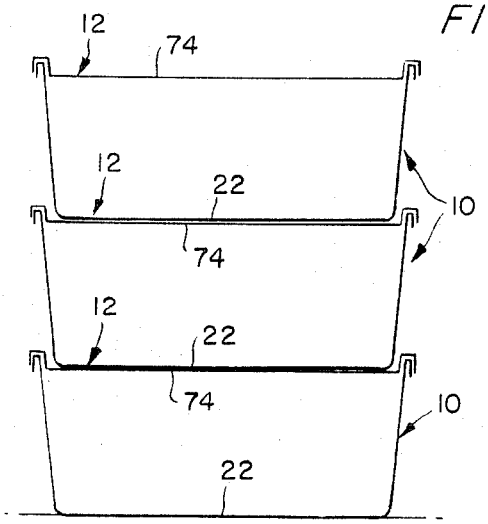
FIG. 15 is a schematic representation of a plurality of sealed tote boxes stacked upon one another.
Figure 16:
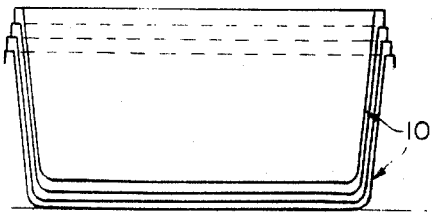
FIG. 16 is a schematic representation of a plurality of tote boxes nested within one another.

FIG. 11, which is an enlarged view of the encircled area of FIG. 2, shows the details of one of the grippers along the length of the inverted cover and box. Also, if desired, tamper indicating bands, or rivets, or padlocks, may be passed through the aligned openings in the flange 80 of the cover and in the flange 24 of the tote box.

The cover 12, even though inverted and positioned upon box 10, still receives and retains tote boxes 10 in a stacking relationship. The bosses 110 maintain the bottom 22 of the superimposed box 10 in the desired relationship. Additionally, the covers 12 can be stacked (n) said cover being executed in a resilient plastic so that said locking tabs on both of said end walls of said cover can be snapped into locking engagement with the slots in the first and second end walls of said tote box.

2. The tote box and security cover of claim 1 wherein a pair of spaced locking tabs are formed on the first end wall of said cover and a similar pair of locking tabs are formed on the second end wall of said cover, so that either pair of locking tabs can coact with either slot in the end walls of said tote box.

3. The tote box and security cover as defined in claim 2 wherein each locking tab has a first horizontal surface, a lower parallel horizontal surface, and a tapered surface joining same to define a wedge-shaped tab.

4. The tote box and security cover of claim 1 wherein said cover has at least one cut-out defined in said first end wall and said flange, and said cover has at least one cut-out defined in said second end wall and said flange, said cut-outs increasing the resiliency of said cover in proximity of said locking tabs.

* * * * *